United States Patent [19]

Matsumoto

[11] Patent Number: 4,683,828

[45] Date of Patent: Aug. 4, 1987

[54] ORNAMENTAL THREAD AUTOMATIC CUTTING DEVICE OF FLAT PLURAL-NEEDLES SEWING MACHINE

[75] Inventor: Takeshi Matsumoto, Osaka, Japan

[73] Assignee: Yamato Mishin Seizo Kabushiki Kaisha, Osaka, Japan

[21] Appl. No.: 769,334

[22] Filed: Aug. 26, 1985

[51] Int. Cl.[4] ..... D05B 65/14

[52] U.S. Cl. ..... 112/294; 112/300

[58] Field of Search ..... 112/285, 291, 293, 294, 112/296, 295, 300

[56] References Cited

U.S. PATENT DOCUMENTS 1,683,689 9/1928 Morrill ..... 112/291
3,424,115 1/1969 Schopf ..... 112/296
3,532,065 10/1970 Marforio ..... 112/300 X
3,998,172 12/1976 Marforio ..... 112/293

FOREIGN PATENT DOCUMENTS 59-55286 3/1984 Japan ..... 112/285

*Primary Examiner*—Wm. Carter Reynolds
*Attorney, Agent, or Firm*—Wenderoth, Lind & Ponack

[57] ABSTRACT

An ornamental thread automatic cutting device of a flat plural-needles sewing machine. Ornamental thread can be cut automatically at the same time as needle thread and looper thread are cut and a cut end of ornamental thread just after passing the eyelet is gripped mechanically upon cutting to facilitate the succeeding sewing operation.

4 Claims, 5 Drawing Figures

ORNAMENTAL THREAD AUTOMATIC CUTTING DEVICE OF FLAT PLURAL-NEEDLES SEWING MACHINE

BACKGROUND OF THE INVENTION

Field of the Invention

This invention relates to an ornamental thread automatic cutting device for a flat plural-needles sewing machine, more particularly, to a cutting device which automatically cuts ornamental threads at the finish of sewing. The moving direction, position, degree of angle, stroke, height, etc. of a movable trimming knife can be adjusted automatically and also a cut end of ornamental thread, just after passing the eyelet, is gripped mechanically upon cutting.

Conventionally, a flat double-needle sewing machine, for example, is so designed that when a pedal is pushed back when sewing is finished, the running sewing machine stops and a needle thread and looper thread are cut automatically. However, as far as an ornamental thread is concerned, automatic cutting means has not been available and it has been a usual practice that after automatic lifting of a presser foot upon cutting of the needle thread and looper thread, an operator pulls sewn fabric in a backward and leftward direction from below the presser foot and then cuts the ornamental thread near the presser foot by scissors and finally removes the sewn fabric from the sewing machine. This manual cutting of ornamental thread is a drawback in this age of super high speed sewing because it is not only inefficient but it also requires skill in cutting ornamental thread manually.

OBJECTS OF THE INVENTION

An object of the present invention is to provide a device whereby an ornamental thread is cut automatically at the same time as a needle thread and a looper thread are cut automatically in a flat 3 needle sewing machine, flat 2 needle sewing machine or the like.

Another object of the present invention is to provide a means of gripping a cut end of the ornamental thread just after passing the eyelet in order to facilitate the succeeding sewing operation.

Another object of the present invention is to provide a device whereby even those who are not skilled in ornamental thread cutting are enabled to perform the cutting operation at a high efficiency without wasting time.

A further object of the present invention is to provide a device whereby ornamental thread can be cut without any mistakes, and in any condition of a top spreader.

SUMMARY OF THE INVENTION

At the finish of sewing on this kind of sewing machine, a triangular shape made by an ornamental thread stretched between a thread hooking part on a top spreader and a sewing finish portion of the ornamental thread varies with the moving locus of a looper which is determined by the number of needles, needle width, type of sewing machine, etc. Therefore, when a movable trimming knife for cutting the ornamental thread thrusts into the triangular shape of stretched ornamental thread, monotonous thrusting of the movable trimming knife must be avoided to effect good cutting of the ornamental thread by a movable trimming knife and a fixed trimming knife, in other words, it is necessary to adjust the movement of a movable trimming knife according to the condition of the top spreader at the end of sewing. The present invention provides an ornamental thread automatic cutting device which ensures good cutting, irrespective of the condition of the top spreader.

BRIEF EXPLANATION OF THE DRAWINGS

The nature and advantage of the present invention will be more apparent from the following description made with reference to the accompanying drawings, in which.

DETAILED DESCRIPTION OF THE INVENTION

Figure 1:
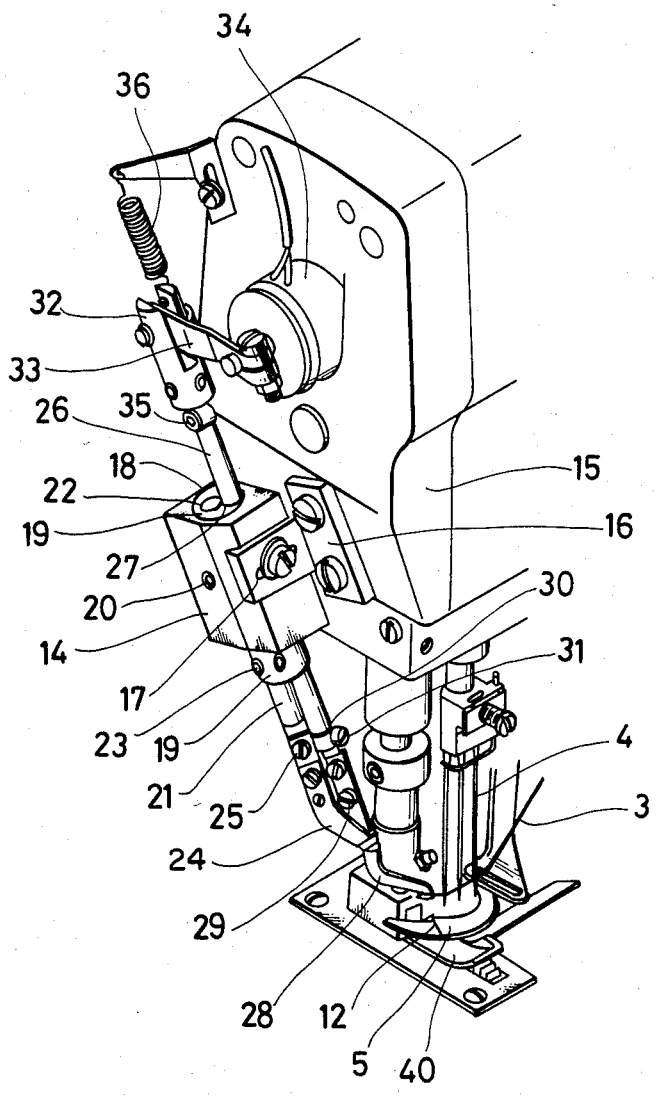
FIG. 1 is a perspective view of the main part of an embodiment of the present invention.
Figure 2:
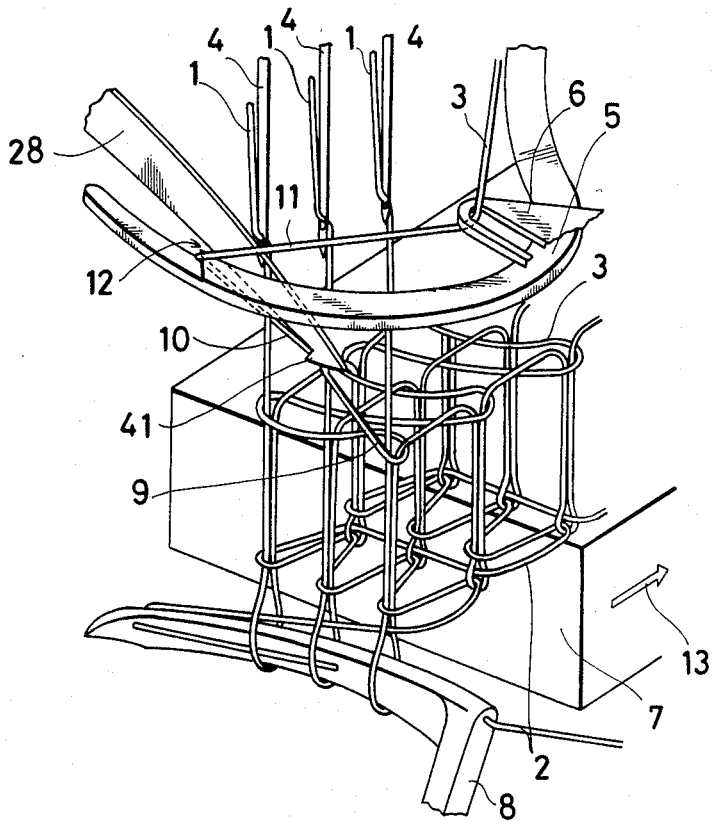
FIG. 2 is a perspective view, on an enlarged scale, of the course of a thread.
Figure 3:
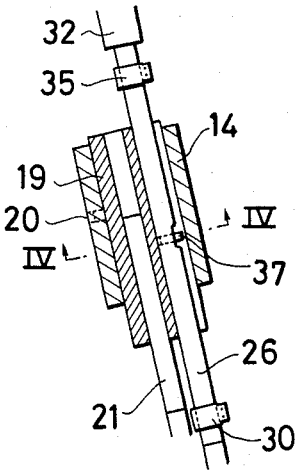
FIG. 3 is a cross sectional view showing the relation between the knife guide holder and the trimming knife shaft.
Figure 4:
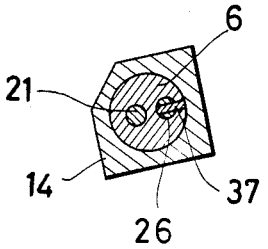
FIG. 4 is a sectional view, taken along line IV—IV in FIG. 3.
Figure 5:
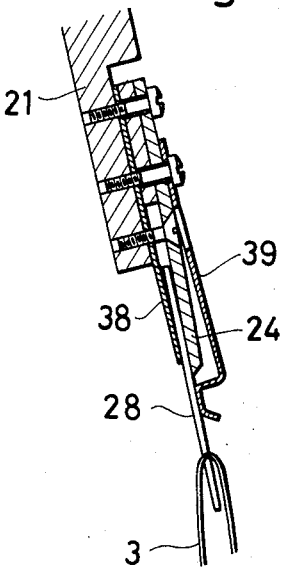
FIG. 5 is a side view showing the relation between the movable trimming knife and the fixed trimming knife.

An embodiment of the present invention is described below with reference to the accompanying drawings.

In the drawings, numeral 1 denotes needle thread. Numeral 2 denotes looper thread. Numeral 3 denotes ornamental thread. Numeral 4 denotes 3 needles. Numeral 5 denotes a top spreader. Numeral 6 denotes an ornamental thread take-up eyelet. Numeral 7 denotes a fabric. Numeral 8 denotes a looper. Numeral 9 denotes a sewing finish portion of the ornamental thread. Numeral 10 denotes a sewing tail of the ornamental thread. Numeral 11 denotes an ornamental thread just after passing the eyelet. Numeral 12 denotes a thread hooking part on the top spreader. Numeral 13 is an arrow direction showing the sewing direction. Numeral 14 is a knife guide holder which is fixed, adjustably in position, to a machine head 15 through a long hole 17 of a knife guide holder bracket 16. Numeral 18 is a through hole extending through knife guide holder 14. Numeral 20 is a screw for knife guide 19 which fixes the knife guide 19 to the knife guide holder 14 in the desired state. Numeral 21 is a fixed trimming knife shaft which extends through a hole 22 in the knife guide 19 and is fixed in the desired state by a screw 23 of the fixed trimming knife shaft 21. Numeral 24 is a fixed trimming knife which is fixed to the lower end portion of the fixed trimming knife shaft 21 by a screw 25. Numeral 26 is a movable trimming knife shaft which at its intermediate part passes through a hole 27 in knife guide 19 which guides the movable trimming knife (adjacent the through hole 22 of knife guide) and has at its lower end a movable trimming knife 28 fixed by a screw 29. Numeral 30 is a movable trimming knife shaft collar for limiting shaft 26 movement in the direction is fixed adjustably relative to the lower part of the knife guide 19 on the movable trimming knife shaft 26 by a screw 31. Numeral 32 is a solenoid connecting block which is fitted to the base end of the movable trimming knife shaft 26. Numeral 33 is a solenoid lever which connects a solenoid 34 for operating the movable trimming knife with the solenoid connecting block 32. Numeral 35 is a movable trimming knife shaft collar acting at a lower limit which is adjustable to adjust the lower limit of movement of the movable trimming knife shaft 26. Numeral 36 is a solenoid return spring which automatically pulls the movable trimming knife upward when a tractive force of the solenoid imparted to the movable trimming knife shaft 26 is released. Numeral 37 is a stop pin interposed between the movable trimming knife shaft 26 and the knife guide 19, by which the movable trimming knife shaft 26 is made slidable in the axial direction but is unrotatable in relation to the knife guide 19. Numeral 38 denotes a knife press adjusting spring. Numeral 39 denotes a thread clamp spring. Numeral 40 is a presser foot.

The present invention is comprised as described above. When a sewing operation is finished and a pedal connected to a driving motor of the sewing machine is pushed back, the sewing machine stops at the predetermined upper dead point of a needle bar and the needle thread 1 and the looper thread 2 are cut by a conventional device, whereupon the solenoid 34 (for operating the movable trimming knife) is actuated and the movable trimming knife 28 advances, against the elasticity of the solenoid return spring 36, toward the intermediate portion of an ornamental thread stretched between the thread hooking part on the top spreader 12 and the sewing finish portion of the ornamental thread 9. Then, the tractive force of the solenoid is lost and the movable trimming knife 28 moves back under the elasticity of the solenoid return spring 36. At this time, ornamental thread 3 is caught by a hooked knife edge 41 of the movable trimming knife 28 and is cut automatically between the movable trimming knife and the fixed trimming knife 24 waiting above it. Since the thread clamp spring 39 which presses the surfae of the movable trimming knife is positioned below the fixed trimming knife 24, a cut end of ornamental thread just after passing the eyelet 6 is held between the movable trimming knife 28 and the thread clamp spring 39, ready the start of the succedding sewing operation.

According to the present invention, ornamental thread 3 is cut automatically together with the needle thread 1 and the looper thread and the relation between the movable trimming knife 28 and the fixed trimming knife 24 can be adjusted accurately to effect good ornamental thread cutting without any mistakes.

What is claimed is.

1. An automatic ornamental thread cutting device for cutting ornamental thread stretched between a finished sewing portion and a thread hooking part of a thread looper of a plural-needle sewing machine, said device comprising:

a knife guide holer mounted to the sewing machine above the thread looper;

a knife guide extending through said knife guide holder;

a fixed trimming knife shaft extending through said knife guide toward the thread looper, and a fixed trimming knife attached to a bottom end of said fixed trimming knife shaft above the thread looper;

a movable trimming knife shaft slidingly guided and extending through said knife guide, a movable trimming knife attached tdo a bottom end of said movable trimming knife shaft, said movable trimming knife having a hooked edge, said movable trimming knife slidable in said knife guide between a first position in which said hooked edge of said movable trimming knife hooks the ornamental thread stretched between the finished sewing portion and the thread hooking part of the thread looper to a second position above the fixed trimming knife at which the ornamental thread hooked by the hooking edge of said movable trimming knife is cut by said fixed trimming knife;

adjusting means for setting and for adjusting said first and second positions relative to said knife guide; and shaft moving means for reciprocating said movable knife trimming shaft, the movement of which is limited between said first and second positions by said adjusting means.

2. An automatic ornamental thread cutting device as claimed in claim 1, wherein said shaft moving means comprises a connecting block attached to a top end of said movable knife trimming shaft above said knife guide, a solenoid operatively connected to said connecting block for initially moving said movable knife trimming shaft to one of said first and second positions, and a spring means operatively connected to said movable knife trimming shaft for returning said movable knife trimming shaft to the other of said first and second positions;

and said adjusting means comprises a first collar adjustably mounted to said movable shaft between said connecting block and said knife guide, and a second collar adjustably mounted to said movable shaft between said knife guide and said movable knife.

3. An ornamental thread cutting device as claimed in claim 1 and further comprising, a clamp spring biased toward said movable knife at said second position and having a thread engaging portion extending just below said fixed trimming knife for clamping the ornamental thread hooked by the hooked edge of said movable knife against said movable knife after it is cut by said fixed trimming knife when said movable knife slides to said second position.

4. An ornamental thread cutting device as claimed in claim 1, wherein said fixed trimming knife shaft is adjustable relative to said knife guide.

* * * * *